US009257753B2

(12) United States Patent
Milroy et al.

(10) Patent No.: US 9,257,753 B2
(45) Date of Patent: Feb. 9, 2016

(54) ARRAY ANTENNA

(71) Applicant: ThinKom Solutions, Inc., Torrance, CA (US)

(72) Inventors: William Milroy, Torrance, CA (US); Shahrokh Hashemi-Yaganeh, Rancho Palos Verdes, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 75 days.

(21) Appl. No.: 14/246,264

(22) Filed: Apr. 7, 2014

(65) Prior Publication Data

US 2015/0288075 A1 Oct. 8, 2015

(51) Int. Cl.
*H01Q 21/00* (2006.01)

(52) U.S. Cl.
CPC ..... *H01Q 21/0006* (2013.01)

(58) Field of Classification Search
CPC ..... H01Q 21/0006; H01Q 1/2225; H04B 5/0062; H04B 7/10
USPC ..... 343/852, 853, 786
See application file for complete search history.

(56) References Cited

U.S. PATENT DOCUMENTS

| | | | | |
|---|---|---|---|---|
| 6,064,350 | A * | 5/2000 | Uchimura | H01P 3/121 343/700 MS |
| 6,201,508 | B1 * | 3/2001 | Metzen | H01Q 13/0258 343/776 |
| 8,537,067 | B2 * | 9/2013 | Tahmisian, Jr. | G01S 13/762 343/772 |
| 2009/0128413 | A1 * | 5/2009 | Crouch | H01Q 3/26 343/700 MS |
| 2009/0309801 | A1 * | 12/2009 | Rao | H01Q 1/288 343/779 |

* cited by examiner

*Primary Examiner* — Hoanganh Le
(74) *Attorney, Agent, or Firm* — Renner, Otto, Boisselle & Sklar, LLP

(57) ABSTRACT

An array antenna includes radiating antenna elements arranged to form an antenna aperture, the radiating antenna elements including a first group and a second group of radiating antenna elements; a corporate feed network configured to feed the radiating antenna elements, wherein the corporate feed network includes a 4-port device including a sum port, a difference port, a first signal port and a second signal port, with the first signal port coupled via the corporate feed network to the first group of radiating elements and the second signal port coupled via the corporate feed network to the second group; a first phase shift element proximal to the antenna aperture to introduce a first predetermined phase shift to the first group of radiating antenna elements; and a second phase shift element proximal to the second signal port to introduce a second predetermined phase shift to the second group of radiating antenna elements.

10 Claims, 3 Drawing Sheets

10

ARRAY ANTENNA

TECHNICAL FIELD

The following relates generally to array antennas, and more particularly to an array antenna which employs phased/coherent cancellation to control and to minimize input reflections.

BACKGROUND ART

Array antennas, such as passive flat plate array antennas, that can provide larger gain and wider bandwidths are in continuous demand for various satellite and point to point communications applications. In a majority of these antennas, the radiating antenna elements are fed by series of corporate feed structures within a corporate feed network that begins with one or two inputs, joined/combined via a (reactive) 3-port T structure. Additional 3-port T structures making up the larger corporate feed network are the main contributors to the amplitude and phase distributions of the radiating elements. These T structures are designed and constructed to provide "widest band" and appropriate power division at each level before ending in the radiating antenna element. To obtain larger gain and bandwidth, it is imperative that each component of the corporate feed network (e.g., each 3-port T structure) and the radiating antenna elements be designed with the lowest possible reflection and the widest bandwidth performance.

However, obtaining a very low reflection (<−40 dB) by each component becomes exceedingly difficult due to the geometry and the manufacturing tolerances associated with today's array antennas. This in turn makes it difficult to achieve very low input reflection coefficient for the entire array. Powerful 3D simulation software has been used to optimize the design and the construction of the feed components. But, the inherent performance limitation of each component set by its boundary conditions, geometrical configuration, and the realistic achievable dimensional tolerances limit the optimized enhancements.

The addition of tuning circuitry to the antenna array input has also been tried to minimize the entire reflection. Unfortunately, the tuning circuitry typically cannot provide the required "wideband" performance if the amplitude of the reflection is large (>−8 dB) and/or highly oscillatory. Furthermore, the tuning circuitry does not provide any benefit with respect to the reflections which occur closer to the radiating antenna elements, hence affecting the radiation pattern.

In view of the aforementioned shortcomings, there is a strong need in the art for an array antenna in which the total input reflection coefficient of the array antenna may be lowered to an acceptable level over wider bandwidth, without reliance on tuning circuitry at the input and without significant degradation of the input reflection or the radiation pattern.

SUMMARY

An array antenna is provided which includes a plurality of radiating antenna elements arranged to form an antenna aperture, the plurality of radiating antenna elements including a first group of radiating antenna elements and a second group of radiating antenna elements distinct in grouping from the first group of radiating antenna elements; a corporate feed network configured to feed the plurality of radiating antenna elements, wherein the corporate feed network includes a 4-port device including a sum port, a difference port, a first signal port and a second signal port, with the first signal port coupled via the corporate feed network to the first group of radiating elements and the second signal port coupled via the corporate feed network to the second group of radiating elements; a first phase shift element proximal to the antenna aperture to introduce a first predetermined phase shift to the first group of radiating antenna elements; and a second phase shift element proximal to the second signal port to introduce a second predetermined phase shift to the second group of radiating antenna elements.

According to an aspect, the first group of radiating antenna elements and the second group of radiating elements each represent a corresponding half of the antenna aperture.

According to another aspect, the first phase shift element includes a flat plate dielectric material placed in front of the first group of radiating antenna elements.

In accordance with another aspect, the flat plate dielectric material includes glass and/or air.

According to yet another aspect, the first phase shift element includes a phase-shift line length coupled between the first group radiating antenna elements and the corporate feed network.

In accordance with still another aspect, the first phase shift element introduces an approximately 90 degree phase shift at mid frequency of an operating band of the array antenna.

According to another aspect, the first signal port and the second signal port represent respective ends of first and second collinear arms included in the 4-port device, and the second phase shift element includes an additional line length in the second collinear arm.

In yet another aspect, the second phase shift element is approximately 90 degrees in length with respect to a mid frequency of an operating band of the array antenna.

According to another aspect, the 4-port device is a magic T coupler, a quadrature hybrid coupler, and/or a quadrature hybrid ring coupler.

According to still another aspect, the corporate feed network is made up of waveguide, microstrip and/or stripline components.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION

An array antenna as described herein incorporates a phased/coherent cancellation technique to control and to minimize an input reflection coefficient seen at the input of magic T, quadrature coupler or other 4-port device, and the subsequent corporate feed structure thereafter, including subsequent phase correction to support a uniform phase condition at the ports of an ensemble feed. Reflections caused by tolerance variation and/or inadequate bandwidth of components are diverted to a loaded sum or difference port of the magic T, quadrature coupler or other 4-port device, while the difference or the sum port is used for the signal input, respectively. Such configuration improves and broadens the main input reflection coefficient aside from any matching circuitry at the input.

Figure 1:
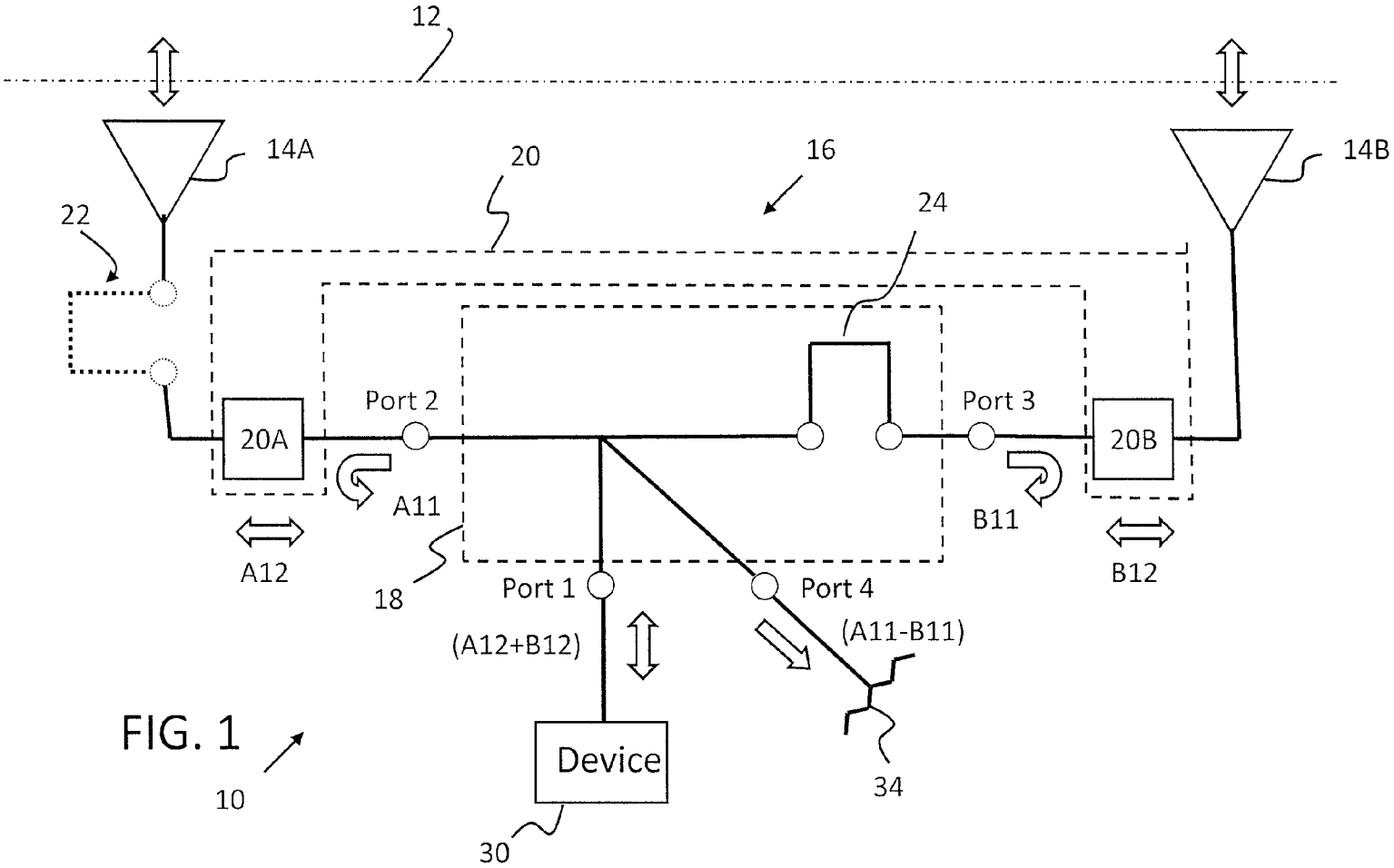
FIG. 1 is a schematic illustration of an exemplary embodiment of an array antenna in accordance with the present invention.

Referring to FIG. 1, an array antenna 10 is shown schematically. In the exemplary embodiment, the array antenna 10 is a flat plate array antenna. The array antenna 10 is intended for transmitting and/or receiving a plane wave denoted by dashed line 12. The array antenna 10 includes a plurality of radiating antenna elements arranged to form an antenna aperture. The plurality of radiating antenna elements are arranged to include a first group of radiating antenna elements 14A and a second group of radiating antenna elements 14B, similar in properties but distinct in grouping, from the first group of radiating antenna elements 14A. In the exemplary embodiment, the first group of radiating antenna elements 14A and second group of radiating antenna elements 14B each represent one half of the radiating antenna elements defining the aperture of the array antenna 10.

The radiating antenna elements may be made up of any suitable known type of array elements such as individual horns in a horn array, slots in a slot array, dipoles in a dipole array, patches in a patch array, etc., as well as any combination thereof. The array antenna 10 may represent an entire antenna, one of several identical elements making up a larger array, a feed for another antenna system, etc., without departing from the scope of the invention.

The array antenna 10 further includes a corporate feed network 16 configured to feed the plurality of radiating antenna elements 14. The corporate feed network 16 includes as an input to the array antenna a 4-port device 18 such as a magic T coupler, quadrature hybrid coupler, quadrature hybrid ring coupler or other such suitable 4-port device. The 4-port device 18 includes a sum port (Port 1), a difference port (Port 4), a first signal port (Port 2) and a second signal port (Port 3). The first signal port (Port 2) is coupled via the corporate feed network to the first group of radiating elements and the second signal port (Port 3) is coupled via the corporate feed network to the second group of radiating elements.

A "4-port device" as defined herein refers to any passive 4-port microwave combining device whose microwave (network scattering) properties provide for vector resolution of two independent (signal) ports into two orthogonal vector components via the remaining two (output/input) ports. Orthogonality of the two vector-resolved channels may be in the form of amplitude pairs ("A+B" and "A−B") or alternatively in the form of complex-conjugate pairs ("A+jB" and "B+jA") depending on the specifics of the particular 4-port device. In the case of the former (amplitude-only) device class, a 90 degree phase-shift (via introduction of a discrete phase-shifter or offset line-length) is added to one of the two signal ports in order to provide the requisite one-way 90 degree phase differential, while this supplemental section is unnecessary when employing a device in the latter (complex-conjugate) class.

The corporate feed network 16 may include a corporate feed structure 20 in addition to the 4-port device 18, the corporate feed structure 20 including any of a variety of conventional corporate feed devices such as couplers, splitters, etc. As described herein, the corporate feed structure 20 may be divided into a first portion 20A and a second portion 20B for feeding the first and second groups of radiating antenna elements 14A, 14B, respectively. The corporate feed structure 20 together with the 4-port device 18 may be constructed using any conventional transmission line approach, including waveguide, microstrip, stripline or other, as will be appreciated.

The array antenna 10 further includes a first phase shift element 22 proximal to the antenna aperture to introduce a first predetermined phase shift, via mechanical and/or dielectric means, to the first group of radiating antenna elements 14A. Additionally, the array antenna 10 includes a second phase shift element 24 proximal to the 4-port microwave device 18, at the second signal port (Port 3) to introduce a second predetermined phase shift to the second group of radiating antenna elements 14B.

The first phase shift element 22 may include a flat plate dielectric material placed in front of the first group of radiating antenna elements 14A. For example, the flat plate dielectric material may include air and/or glass as discussed below with respect to FIGS. 2 and 3, respectively. As another example, the first phase shift element 22 may include a phase-shift line length coupled between the first group of radiating antenna elements 14A and the corporate feed network 16. The line length may be made up of waveguide, microstrip, stripline, etc., as will be appreciated. The first phase shift element 22 preferably is configured to introduce an approximately 90 degree phase shift at mid frequency of an operating band of the array antenna. As referred to herein, "approximately 90 degrees" refers to a phase shift within the range of 90 degrees, plus or minus 20 degrees.

In an embodiment in which the 4-port device includes a magic T coupler, the first signal port (Port 2) and the second signal port (Port 3) represent respective ends of first and second collinear arms included in the magic T coupler. The second phase shift element 24 is an additional line length in the second collinear arm added to compensate for the phase balance introduced by the first phase shift element 14A.

In an embodiment where the first phase shift element 22 is approximately 90 degrees, the second phase shift element 24 is approximately 90 degrees in length with respect to a mid frequency of an operating band of the array antenna 10. The second phase shift element 24 may be made up of waveguide, microstrip, stripline, etc., as will be appreciated.

The 4-port device 18 may be any of various known types of 4-port devices including, for example, a magic T coupler, a quadrature hybrid coupler, and/or a quadrature hybrid ring coupler.

Continuing to refer to FIG. 1, a device 30 such as a transmitter has its output connected to the sum port (Port 1) of the 4-port device 18. The device 30 outputs a signal (A12+B12) into Port 1. One half of the signal (A12) is directed towards the first group of radiating antenna elements 14A via Port 2 and the first portion 20A of the corporate feed structure 20. The other half of the signal (B12) is directed towards the second group of radiating antenna elements 14B via Port 3 and the second portion 20B of the corporate feed structure 20. Undesired reflections at Port 2 (A11) are reflected back into Port 2 and are directed within the 4-port device 18 to the difference port (Port 4) which is terminated with a load 34 designed to absorb the reflections. Similarly, undesired reflections at Port 3 (B11) are reflected back into Port 3 and are directed within the 4-port device 18 to the difference port (Port 4) and into the load 34.

It will be appreciated that the device 30 could be connected to the difference port (Port 4) and the load 34 connected to the sum port (Port 1) and similar operation occurs.

Thus, the array antenna 10 enjoys a substantial improvement in VSWR by channeling the reflection caused by tolerance variation and/or inadequate components' bandwidth to the "loaded" sum or difference ports of the magic T, quadrature coupler or other 4-port device, while the difference or the sum port used for the signal input, respectively. Degradation in the input reflection or the radiation pattern is avoided since the phase change in half of the aperture is corrected by the introduction of the second phase shift element 24 while the undesired reflection is channeled into the loaded arm of the 4-way power divider isolated from main input. The array antenna 10 thus presents the simplicity of using a piece of flat plate dielectric plus simple phase adjustment (e.g., in the collinear arms of a magic T) to achieve broader bandwidth without complicated matching circuitry at the input.

In exemplary embodiments, a half aperture sized flat plate dielectric material serving as the first phase shift element 22 is placed in front of the first group of radiating antenna elements 14A representing one half of the antenna aperture. At the same time, the 4-port device 18 feeding the entire aperture includes a purposeful phase shift in the form of the second phase shift element 24 to compensate for the phase imbalance in the aperture introduced by the first phase shift element 22. This intentional phase shift at the aperture and the 4-port device provides desired VSWR cancellation properties.

The half aperture sized flat plate dielectric material serving as the first phase shift element 22 should be a half wavelength (wavelength inside the dielectric medium) thick around the mid frequency of the operating band of the array antenna 10. Ideally, glass material with the dielectric constant of 4 can provide the thickness which is exactly the quarter of wavelength in free space and translates to a 90 degrees phase shift in free space. However, in the absence of the glass other dielectric materials, with appropriate thicknesses, can also be used to achieve similar improvement, while departing from a rigorous half-wavelength thickness criteria. Alternatively, multi-layer embodiments may be employed as the phase-shift element 22, in order to simultaneously provide both the desired insertion phase correction and desired input match properties.

Figure 2A:
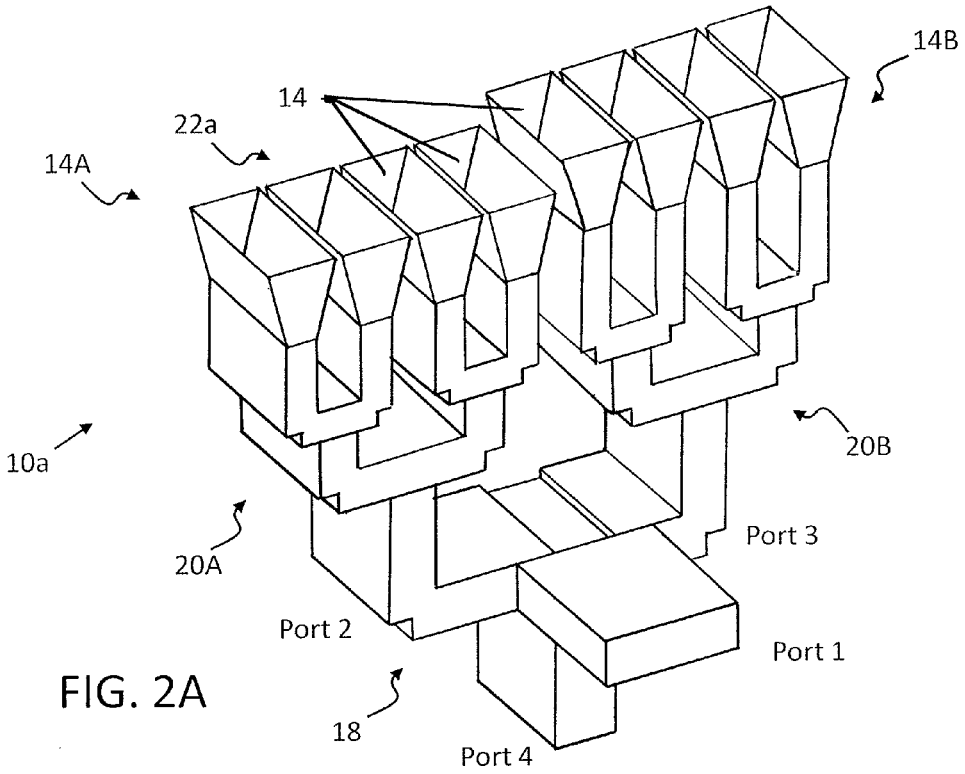
FIGS. 2A and 2B illustrate a perspective view and a front view, respectively, of a first particular example of an array antenna in accordance with the present invention.
Figure 2B:
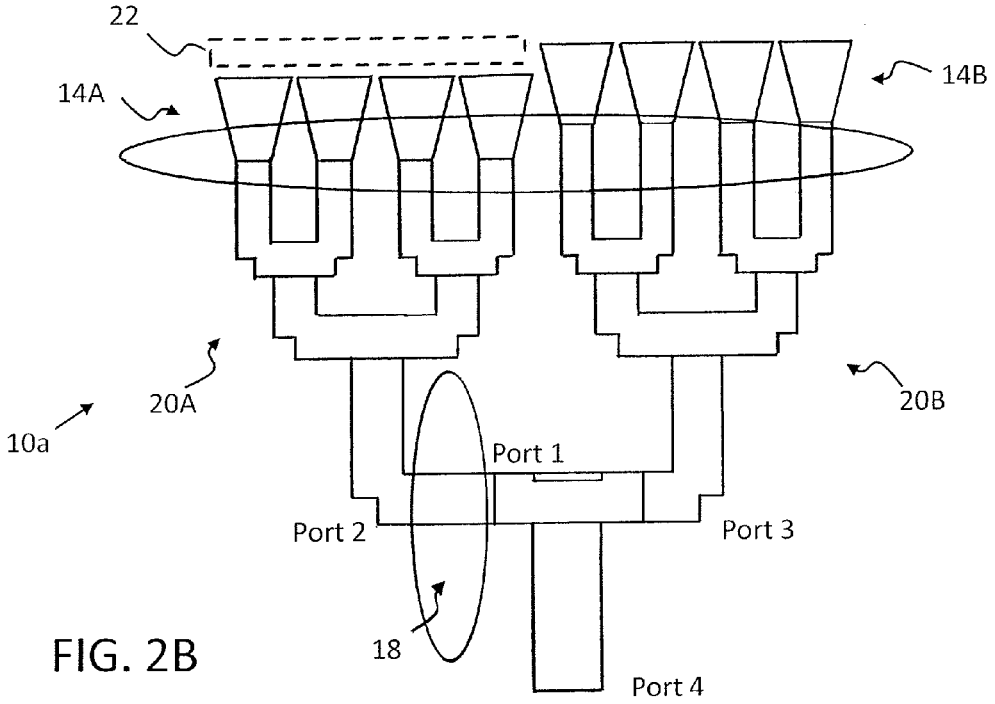

Referring to FIGS. 2A-2B, shown is a first particular embodiment of the present invention as described herein. The first group of radiating antenna elements 14A is made up of four radiating antenna elements 14 coupled to Port 2 of the 4-port device 18 via a 1-to-4 power divider corporate feed structure 20A. Similarly, the second group of radiating antenna elements 14B is made up of four radiating antenna elements 14 coupled to Port 3 of the 4-port device 18 via a 1-to-4 power divider corporate feed structure 20B.

The 4-port device 18 in this embodiment is a 4-port waveguide magic-T. Moreover, in this embodiment the first phase shift element 22 is made up of a recessed half aperture. In this manner, the first phase shift element is an air dielectric 22*a* and is configured to introduce an approximately 90 degree phase shift at mid frequency of an operating band of the array antenna. To offset the radiated phase impact due to the introduction of the air dielectric 22*a*, the 4-port device 18 includes phase imbalanced collinear arms. Specifically, the collinear arm at Port 3 includes an additional 90 degree feed-line length representing the second phase shift element 24.

Figure 3A:
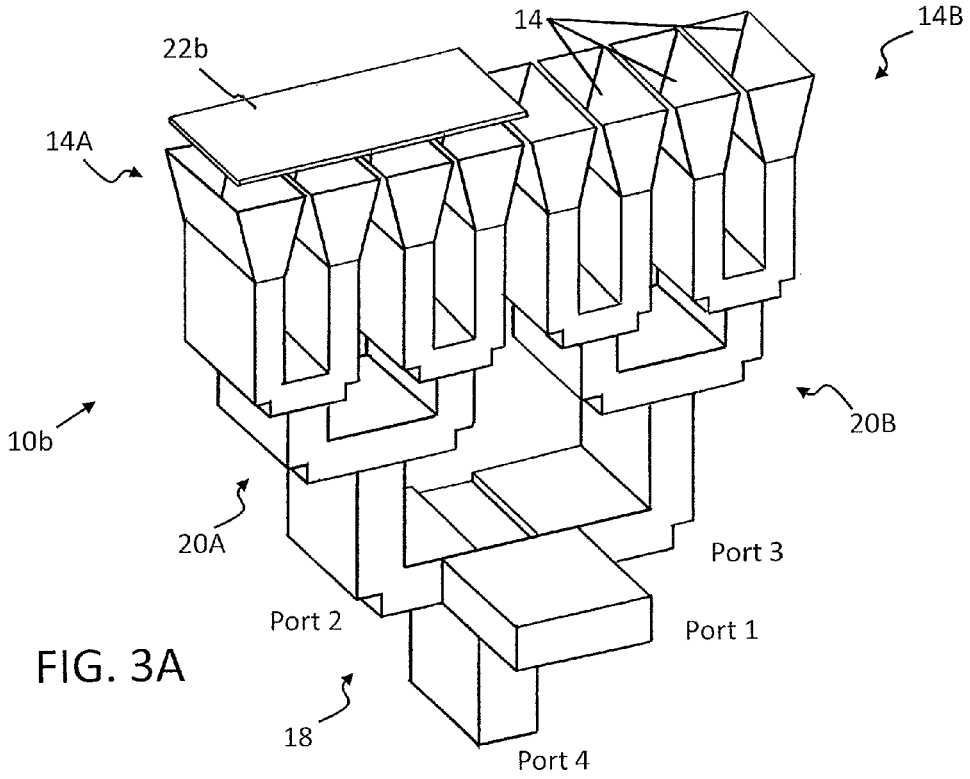
FIGS. 3A and 3B illustrate a perspective view and a front view, respectively, of a second particular example of an array antenna in accordance with the present invention.
Figure 3B:
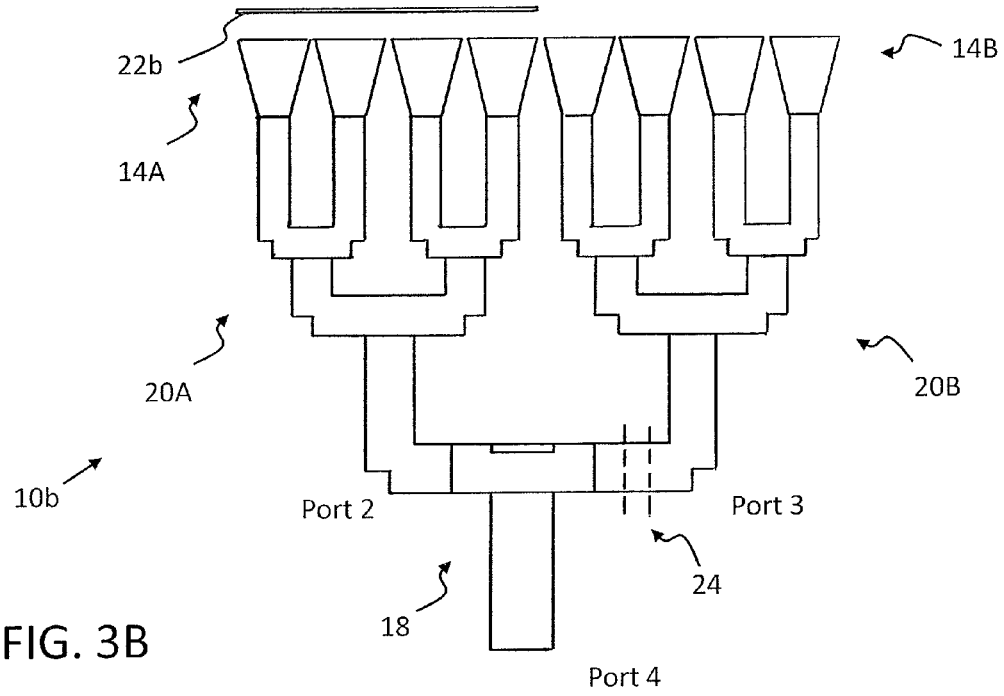

FIGS. 3A and 3B illustrate another particular embodiment similar to the embodiment of FIGS. 2A-2B but with the following exceptions. Rather than the air dielectric 22*a*, dielectric plate 22*b* is introduced at the antenna aperture in front of the radiating antenna elements 14A. To offset the radiated phase impact due to the introduction of the dielectric plate 22*b*, the 4-port device 18 again includes phase imbalanced collinear arms. Specifically, the collinear arm at Port 3 includes an additional 90 degree feed-line length representing the second phase shift element 24.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

The invention claimed is:

1. An array antenna, comprising:

a plurality of radiating antenna elements arranged to form an antenna aperture, the plurality of radiating antenna elements including a first group of radiating antenna elements and a second group of radiating antenna elements distinct in grouping from the first group of radiating antenna elements;

a corporate feed network configured to feed the plurality of radiating antenna elements, wherein the corporate feed network includes a 4-port device comprising a sum port, a difference port, a first signal port and a second signal port, with the first signal port coupled via the corporate feed network to the first group of radiating elements and the second signal port coupled via the corporate feed network to the second group of radiating elements;

a first phase shift element proximal to the antenna aperture to introduce a first predetermined phase shift to the first group of radiating antenna elements; and a second phase shift element configured atproximal to the second signal port to introduce a second predetermined phase shift to the second group of radiating antenna elements.

2. The array antenna according to claim 1, wherein the first group of radiating antenna elements and the second group of radiating elements each represent a corresponding half of the antenna aperture.

3. The array antenna according to claim 1, wherein the first phase shift element comprises a flat plate dielectric material placed in front of the first group of radiating antenna elements.

4. The array antenna according to claim 3, wherein the flat plate dielectric material includes glass and/or air.

5. The array antenna according to claim 1, wherein the first phase shift element comprises a phase-shift line length coupled between the first group radiating antenna elements and the corporate feed network.

6. The array antenna according to claim 1, wherein the first phase shift element introduces an approximately 90 degree phase shift at mid frequency of an operating band of the array antenna.

7. The array antenna according to claim 1, wherein the first signal port and the second signal port represent respective ends of first and second collinear arms included in the 4-port device, and the second phase shift element comprises an additional line length in the second collinear arm.

8. The array antenna according to claim 7, wherein the second phase shift element is approximately 90 degrees in length with respect to a mid frequency of an operating band of the array antenna.

9. The array antenna according to claim 1, wherein the 4-port device is a magic T coupler, a quadrature hybrid coupler, and/or a quadrature hybrid ring coupler.

10. The array antenna according to claim 1, wherein the corporate feed network is made up of waveguide, microstrip and/or stripline components.

* * * * *